United States Patent [19]

Snygg

[11] Patent Number: 4,979,689

[45] Date of Patent: Dec. 25, 1990

[54] METHOD AND APPARATUS FOR WINDING A WEB

[75] Inventor: Keijo Snygg, Karhula, Finland

[73] Assignee: Valmet-Ahlstrom Inc., Karhula, Finland

[21] Appl. No.: 372,448

[22] Filed: Jun. 28, 1989

[30] Foreign Application Priority Data

Jul. 4, 1988 [FI] Finland ..... 883178

[51] Int. Cl.[5] ..... B65H 19/30

[52] U.S. Cl. ..... 242/65

[58] Field of Search ..... 242/65, 75.3

[56] References Cited

U.S. PATENT DOCUMENTS

| | | | |
|---|---|---|---|
| 3,202,374 | 8/1965 | Phelps . | |
| 3,494,566 | 7/1968 | Pawelczyk | 242/65 |
| 3,586,253 | 6/1971 | Gilbank et al. | 242/65 |
| 4,283,023 | 8/1981 | Braun et al. | 242/67.1 R |
| 4,546,930 | 10/1985 | Rohde et al. | 242/65 X |
| 4,744,526 | 5/1988 | Kremar . | |
| 4,778,122 | 10/1988 | Snugg | 242/65 X |

FOREIGN PATENT DOCUMENTS 3244510 10/1983 Fed. Rep. of Germany .

*Primary Examiner*—Daniel P. Stodola

*Attorney, Agent, or Firm*—Nixon & Vanderhye

[57] ABSTRACT

An apparatus and method for engaging a reel spool with a Pope reel on a web winding machine. Primary forks lower a new reel spool into nip contact with the Pope reel. After being brought into nip contact, the reel spool is supported by the Pope reel and support plates mounted on the primary forks. As the primary forks continue to lower the reel spool, the contact area between the supporting plates and reel spool changes so as to maintain a substantially constant pressure between the reel spool and Pope reel. The primary forks lower and transfer the reel spool onto reel tracks. The primary forks are then repositioned to receive the next reel spool.

8 Claims, 2 Drawing Sheets

METHOD AND APPARATUS FOR WINDING A WEB

The invention relates to a method for on-machine winding of a web, in which method a Pope reel drum or corresponding is used over which the web to be wound is conducted and in which method new reel spools are brought into connection with a reel drum, after which the web is conducted from the fully wound reel to be wound onto a new reel spool.

The invention also relates to an apparatus for on-machine winding by which a web coming from a paper machine or a corresponding machine for web-making is wound onto reel spools and which apparatus comprises a reel drum provided with drive means and primary forks in connection with it, which bring the empty reel spools onto the surface of the reel drum, and tracks supported on which the machine roll builds up while being wound.

According to prior art it is common to use a so-called Pope reeler to wind, among others, the paper web coming from a paper machine, whereby the roll is wound on a so-called reel spool and the roll building up is pressed against the driving roll, a so-called Pope reel drum, touching which the web partly runs and which is rotated at a peripheral speed matching the speed of the web.

In prior art machines the reel spool is brought onto the primary arms from the storage frame by means of separate arms. An arrangement like this is very tall, while the lifting heights of the cranes, especially in older machine halls, are often not adequate for this. For reasons referred to above, high costs are caused. An apparatus of this type is disclosed in the Finnish patent No. 860834.

In prior art machines, the load at the nip of the reel spool and the reel drum is achieved by means of a roll and a loading device. When in the upper position, the load is effected by the weight of the reel spool itself as well as by the load from the loading device, but when directing the spool supported on the primary arms towards the lower position, the force component from the weight of the spool itself diminishes and is at zero when the reel reaches the lower position, at which point only the load force applied by the loading device is effective. For the above reasons, a special load relief cylinder is needed to control the pressure force caused by the weight of the reel spool. The pressure of the cylinder has to be steplessly adjusted during the lowering of the primary forks.

The present technology cannot provide a cheap stepless way of transmission functioning without a synchronizing shaft which would, at the same time, provide a reliable even run, as in this solution also the load relief cylinders expand during the movement of the primary forks. Such an apparatus is disclosed in Valmet's U.S. Pat. No. 4,624,068.

It is an object of the present invention to provide a method and apparatus for winding a web by means of which an even distriburion of load across the width of the paper web is achieved between the reel spool and the reel drum during the exchange of reel spools.

It is a furhter object of the present invention to provide a method and apparatus for achieving a speedy exchange of the reel spools.

It is a still further object of the invention to provide a simple and reliable construction where the need for auxiliary equipment is minimized.

The method according to the invention for achieving the objects referred to above, is mainly characterized in that the method comprises, in combination, the following steps:

(a) when in the upper position, the primary forks pick up the empty reel spool without any auxialiary equipment, (b) guided by the primary forks and supported on support plates attached to the primary forks, the empty preaccelerated reel spool is brought into nip contact with the rotating reel drum, through which nip the web to be wound runs and is wound around the reel spool at this nip contact, the support plates being retained in such a position during the lowering of the primary forks that the contact pressure between the reel spool and the reel drum is maintained substantially constant while the primary forks move from their upper position to their lower position (see vector diagrams. FIG. 2).

(c) the primary forks being in their lower position, the support plates are turned into such a position that they pass the reel spool, already supported on the reel tracks, as the primary forks are moving back to their upper position. The steps described above are repeated when it is time to change reel spools again and the support plates are ready for receiving one.

The apparatus according to the invention is mainly characterized in that the reeler comprises a storage frame for storing the empty reel spools to be ready to be picked up by the primary forks.

support plates attached to the primary forks, supported on which the empty reel spool can be brought into nip contact with the rotating reel drum by lowering the primary forks and which support plates are provided with a counter surface whose shape and position is such that when lowering the reel spool the contact pressure between the reel drum and the reel spool remains essintially constant regardless of the height position of the reel spool.

The exchangeable support plates can vary in design for achieving the suitable contact pressure for each paper grade. The support plates can also be fixed with regard to the primary forks. In that case the primary fork can only be elevated when the paper roll is built up to adequate size.

Due to a turning mechanism for the support plates, a swift turn of the primary forks into the upper position is made possible, which is useful in exeptional situations, for example if there is a failure with starting a new paper roll and an exchange of reel spools must immediately be carried out. The turning of support plates that are pivotally mounted to the primary forks is accomplished either by the force of gravity, or a spring, or a hydraulic or pneumatic cylinder controlled by, e.g., a limit switch depending on the position of the primary forks. The relief of load necessary for delicate paper grades is accomplished by means of hydraulic cylinders located at the upper portion of the primary arms directly underneath the bearing housings of the reel spool. The relief of load diminishes the contact pressure, but it still remains essentially constant.

In the apparatus according to the invention, special means for lifting the reel spool from the storage frame onto the primary arms is not needed, as the shape of the primary arms and the pivoting point are such that, while being elevated, the primary arms pick up the empty reel spool from the storage frame. Furthermore, the susrface of the beam of the storage frame is inclined towards the primary arms, due to which fact the new reel spool can replace the the previous reel spool taken to the reeler.

No auxiliary equipment is needed for achieving a contact force between the spool and the reel drum, as the contact force is accomplished by means of the weight of the spool itself and a suitable angle chosen for the counter surfaces of the support plates.

The invention is described in the following with reference to an embodiment shown if the figures of the attached drawings, to the details of which the invention is by no means strictly limited.

Figure 1:
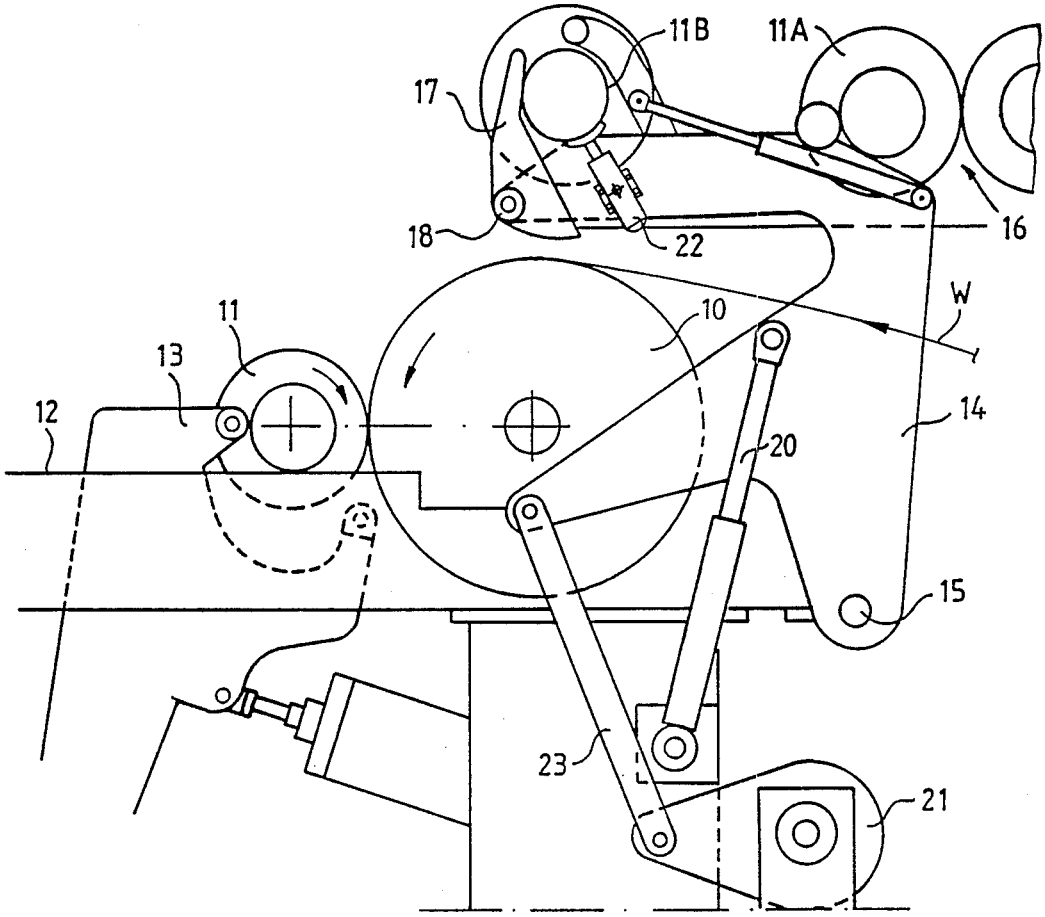
FIG. 1 is a general side view of a reeler constructed in accordance with the invention.

The function of the reeler according to the invention is described in the following.

The principal part of the Pope-type reeler schematically shown in the figures includes a reel drum 10, along the periphery of which the paper web runs for a little over a quarter of a revolution before it is transferred on the periphery of the paper roll building up around a reel spool 11C. A reel spool 11E is supported and rotates on two support tracks 12, while secondary forks 13 press it against the reel drum 10. The secondary forks also move the paper roll off the reel drum 10, when it reaches the desired diameter.

The reel spool is designated by 11A, 11B, 11C, 11D, or 11E depending of the phase of winding it is in. 11E shows the reel spool just before it is removed from the support plates, but is still supported on them. After the removal of the reel spool, the secondary forks press the reel spool into a nip contact with the reel drum. The designation 11 is used when referring to the reel spool in general and no specific position is referred to.

The fully wound paper rolls are transferred to the left for further treatment along the support tracks 12, whereupon the empty core shafts are returned by means of, e.g., a bridge crane onto storage tracks 16 located on the right above the support tracks 12.

Primary forks 14 constitute the exchange means of the reel spools 11.

When changing reel spools 11, the primary forks 14 are elevated to their upper position. The shape of the primary forks 14 and the pivoting point 15 have been chosen in the way that they, when elevated, pick up the empty reel spool 11B from the storage frame 16. The upper surface of the storage frame is inclined towards the exchange point of the reel spools in order to enable a new reel spool 11A to roll to a point where it is ready to be picked up by the primary forks 14 when it is time to change reel spools again. Support plates 17 are attached to the primary forks 14, which support the reel spool 11B–E on which the paper roll is built up. The primary forks 14 are now lowered to allow the periphery of the reel spool 11C to approach the periphery of the reel drum 10 and the distance between the reel spool 11C and the reel drum 10 diminishes further until the reel spool 11C, which has been preaccelerated and reached approximately the same peripheral speed as the reel drum, touches the paper web W running on the reel drum 10 and reaches the exact peripheral speed of the reel drum. The transfer of the web W can now be carried out in a manner known per se, and a new reel spool 11E can be lowered onto the support tracks 12 replacing the previous one. At stage 11C, where the reel spool presses against the web, the exchange of reel spools is carried out and in many prior art solutions broke is produced for about half a minute. In this solution the new reel spool 11C can start receiving web while the previous machine roll is still in nip contact with the reel drum 10, if the web is being cut by using a sharp-pointed object to make a hole in the web before blowing, or the use of an edge blowing method or a cord cutting device (prior art techniques). If again the cutting of the web is performed by pocket blowing (medium or thick paper grades), the nip contact with the full machine roll 11E has to be disengaged first and only then can the web be cut off. In any case, when using the solution according to the invention, the exchange is carried out in the speediest possible manner and the amount of broke produce is the least possible.

Figure 2:
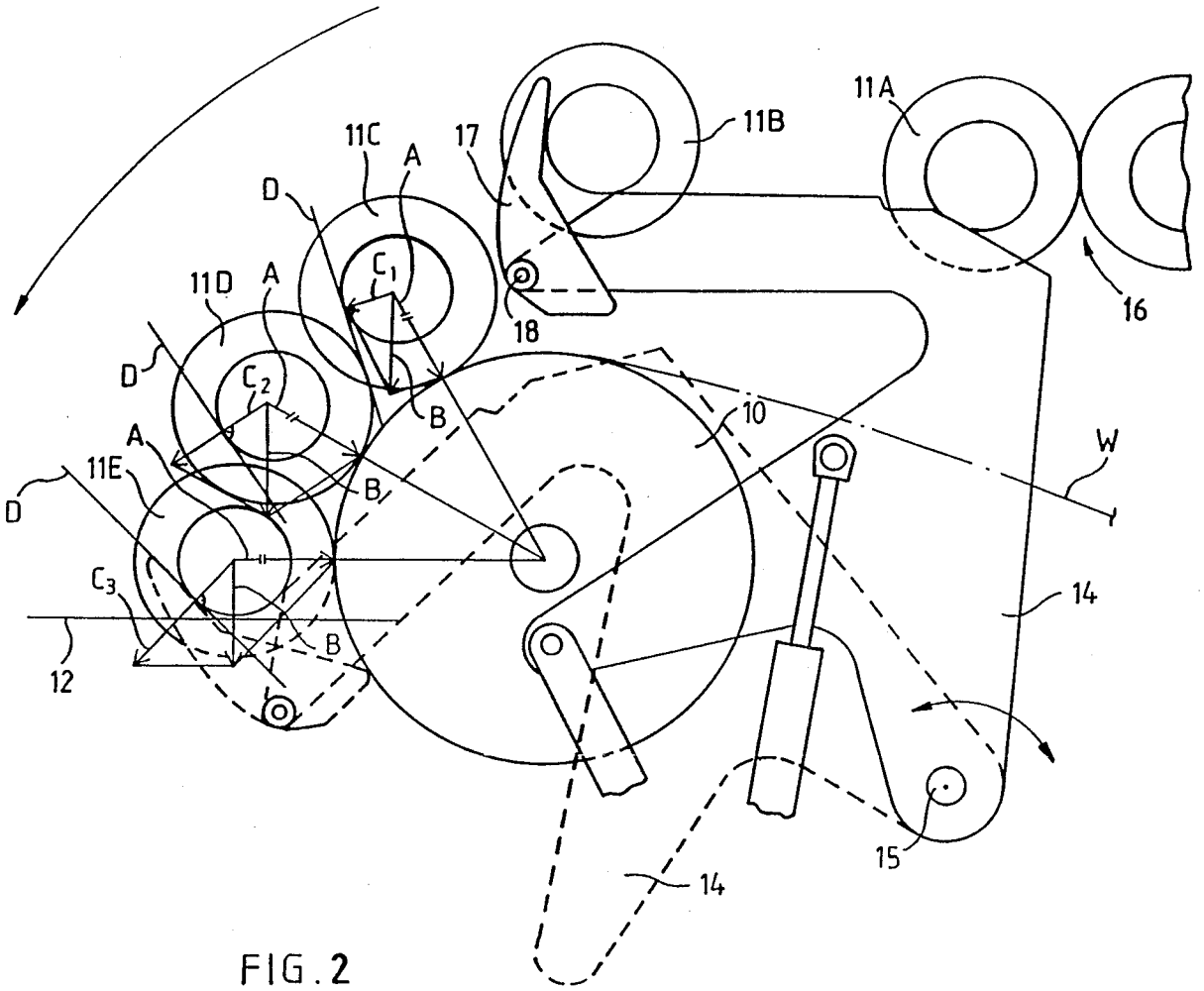
FIG. 2 is a fragmentary view of the reeler showing schematically the control system for the contact force between the reel spool and the reel drum according to the invention.

FIG. 2 shows the various stages 11A, 11B, 11C, 11D, 11E of the reel spool 11 when it is being transferred onto the support tracks 12, supported on the support plates 17, by the primary forks 14. During stages 11C–11E the support angle of the support plates 17 adjusts itself in the way that the contact pressure between the spool 11 and the reel drum, while lowering the primary forks 14, remains essentially constant. The support plates are pivotally mounted on the primary forks 14 and shaped in the way that while the primary forks are in their lower position and the reel spool 11E on the roll tracks 12, the support plates 17 pivot round their pivot point 18 into such a position in the primary forks 14 that the primary forks 14 can be elevated back into the upper position passing the the reel spool 11E supported on the tracks 12. In the embodiment according to the Figure, the pivoting of the support plates 17 is accomplished by making the portion to the right of the pivot point 18 of the support plate heavier than the left hand side portion. When the primary fork has been lowered as far as the tracks 12, it continues turning downward until the support plate can tip over from behind the reel spool into a fixed position whereby it can make its way past the reel spool back into the upper position. This solution can, when desired, be replaced by a mechanical or hydraulic movement, which produces the same result but is more costly. The primary forks 14 are arranged to function simultaneously, for example by means of a synchronizing shaft 21, which is disposed outside the pivot points 15 by means of connecting rods 23 in order to decrease the moment applied to the shaft 21 in proportion to the transmission ratio. The relief force required by some web materials is achieved by a relief cylinder 22, which is disposed in the upper portion of the primary forks 14 directly beneath the bearing housings of the reel spool 11B. The pressure is set while the primary forks are in the upper position, and is kept constant while the primary forks move from the upper position to the lower.

In the following, the functioning principle of the support plates constructed in accordance with the invention is described in more detail referring to FIG. 2.

According to the invention, the contact pressure is achieved in the nip contact between the reel spool 11 and the reel drum 10 due to the weight of the spool 11B–E itself. When the reel spool 11 moves downwards while the primary forks are being lowered, the action of the gravity force on it is directly vertical, which force is represented by vector B. This force acting on the spool is divided into two force components, of which one, A, is the contact force between the reel spool and the reel drum. The force A remains almost constant during the entire downward movement of the primary forks. References C1, C2, and C3 designate the size of the force component that together with vector A constitutes the sum vector B. The force component C1, C2 and C3 is determined by the contact angle of the counter surface of the support plate 17, which in turn is determined in such a way that the force component A in the vector sum A+C=B is always almost the same in the various positions of the reel spool 11. Line D in the Figure is the line that represents the position of the counter surface of the support plate, against which the reel spool is supported, in other words, against which vector C is right-angled.

The contact force A remains almost constant during the lowering stage. At the point where the support plates transmit the reel spool onto the secondary arms 13, the support plates are mechanically synchronized by means of a synchronizing shaft 21. This is to prevent uneven load when the secondary load is engaged, and thus maintain the web even and unwrinkled, which considerably decreases the amount of broke, as a failure at the initial stage of winding would result in an interruption of the winding operation and unwinding of the roll into broke.

Figure 3:
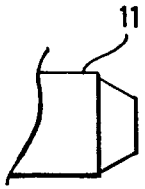
FIG. 3 is a side view of a portion of a reel spool showing a bearing of various diameters.

It has to be pointed out that the invention is by no means limited to the embodiment presented above, but the details may vary a great deal within the scope of the inventional concept. The support plates may, for instance, be of a curved shape or the bearing housings of the reel spool may have various diameters, as shown in FIG. 3, thus disposing the support point of the support plates at different points of the support plate. By this technique, the control of the pressure force can be achieved in a similar way as by adjusting the support angle of a straight support plate, such as described above.

In the following the patent claims are presented, which define the inventional concept within the scope of which the details of the invention may vary.

What is clained is:

1. A method for engaging reel spools with a Pope reel in a winding machine having a primary fork for carrying a reel spool, support plates pivotally mounted on the primary fork for holding a reel spool against the Pope reel, and reel tracks to receive a reel spool from the primary fork, the method comprising the steps of:

a. mounting a reel spool onto the primary fork;

b. moving the primary fork to bring the reel spool into nip contact with the Pope reel;

c. distributing the weight of the reel spool between the support plates and the Pope reel;

d. maintaining a substantially constant pressure between the reel spool and the Pope reel by changing the location of contact between the reel spol and support plates while the reel spool is lowered onto the reel tracks, and e. repositioning the primary fork to receive another reel spool.

2. The method of claim 1, wherin step (d) is practiced by moving the reel spool along the surface of the support plates to change the contact location.

3. The method of claim 1, wherein the reel spool has a bearing of various diameters and step (d) is practiced by changing location of contact between the bearing and support plates.

4. The method of claim 1, comprising the further step (e) of turning the support plates in towards the primary forks so that the support plates avoid the reel spool as the primary fork is repositioned.

5. An apparatus to mount a reel spool onto a web-winding machine comprising, a. a Pope reel feeding a web to said reel spool to be wound;

b. a primary fork bringing said reel spool into nip conatct with said Pope reel and lowering said reel spool onto reel tracks; and c. support plates pivotally on said primary fork, the weight of said reel spool being distributed between said support plates and said Pope reel, the location of between said support plates and said reel spool changes as said reel spool is lowered so as to maintain a substantially constant pressure between said reel spool and said Pope reel.

6. An apparatus as in claim 5 wherein said location of contact area on said support plates is a counter surface.

7. An apparatus as in claim 5 wherein said contact location on said reel is the surface of a bearing having various diameters.

8. An apparatus as in claim 5 wherin said primary fork pivots to cause said location of contact to change.

* * * * *